US006638337B1

(12) United States Patent
Bray et al.

(10) Patent No.: US 6,638,337 B1
(45) Date of Patent: Oct. 28, 2003

(54) METHOD OF INTRODUCING ADDITIVES IN STEELMAKING

(75) Inventors: Stephen David Bray, Swansea (GB); Keith Harris, West Glamorgan (GB)

(73) Assignee: Qual-Chem Limited, West Glamorgan (GB)

( * ) Notice: Subject to any disclaimer, the term of this patent is extended or adjusted under 35 U.S.C. 154(b) by 0 days.

(21) Appl. No.: 10/070,413

(22) PCT Filed: Sep. 18, 2000

(86) PCT No.: PCT/GB00/03578

§ 371 (c)(1),
(2), (4) Date: Jul. 16, 2002

(87) PCT Pub. No.: WO01/20047

PCT Pub. Date: Mar. 22, 2001

(30) Foreign Application Priority Data

Sep. 16, 1999 (GB) ..... 9921818
Mar. 24, 2000 (GB) ..... 0007073

(51) Int. Cl.[7] ..... C21C 5/00

(52) U.S. Cl. ..... 75/533; 75/537; 75/560; 266/221; 266/267; 266/47

(58) Field of Search ..... 75/533, 537; 266/221, 266/267, 47

(56) References Cited

U.S. PATENT DOCUMENTS 3,010,820 A * 11/1961 Graff et al. ..... 75/538
3,740,044 A * 6/1973 Uemlianin ..... 75/476
3,823,012 A * 7/1974 Johnstone et al. ..... 75/533
5,279,639 A * 1/1994 Kemeny et al. ..... 75/309
5,332,199 A 7/1994 Knapp et al.
5,427,604 A * 6/1995 Loving et al. ..... 75/537
6,267,798 B1 * 7/2001 Kemeny et al. ..... 75/312

FOREIGN PATENT DOCUMENTS

WO 769 269 A 3/1957
WO 2162858 B 9/1987
WO WO 96 24697 A 8/1996
WO 198 20 589 A 11/1999

OTHER PUBLICATIONS

Database WPI, week 197615, Derwent Publications Ltd., London, GB, AN 1976–27285x, XP002156599, "Retractable, rotatable and inclinable additive pipe", & JP 51 023420 A (Nippon Steel Corp.), Feb. 25, 1976, abstract.

Patent Abstracts of Japan, vol. 1997, No. 09, Sep. 30, 1997, & JP 09 118911 A (Technic Sangyo KK; Tamasa Kogyo KK), May 6, 1997, abstract.

* cited by examiner

*Primary Examiner*—Roy King
*Assistant Examiner*—Andrew Wessman
(74) *Attorney, Agent, or Firm*—Bacon & Thomas

(57) ABSTRACT

The additives, in particulate solid form, are conveyed pneumatically in a divergent stream from a pneumatic gun to impinge upon the molten iron and mix therewith. The gun is spaced above a surface of molten iron such that the pneumatically conveyed stream including the additive has a central axis which is either horizontal (or at an acute angle to the horizontal). The gun is prefereably adjustable for adjustment of the stream angle, and the stream may be either added to pouring metal or to cover a surface of the molten iron.

11 Claims, 5 Drawing Sheets

METHOD OF INTRODUCING ADDITIVES IN STEELMAKING

The present invention relates to a method of introducing additives during steelmaking, either to molten iron in a ladle or the like, or to molten iron while the latter is being poured.

Conditioning of steel at various stages in steelmaking processes often requires the introduction at relevant process stages of various additives (such additives are often known as conditioning agents because they "condition", or change the properties and/or the composition of, the resulting steel). In conventional arrangements, such additives may be introduced by gravity feed (by flow of the additive from a hopper or the like placed above the molten metal), or by direct injection into molten metal or slag, using, for example, a lance arranged vertically above the hot metal (the latter being typically in a runner for directing molten pig iron tapped from a blast furnace into a hot metal ladle).

U.S. Pat. No. 4,601,749 discloses a method of the latter type, in which a lance is arranged vertically above such a hot metal runner. The method disclosed is relatively inflexible in its operation, and requires the injection lance to be arranged in the very aggressive environment of just above the surface of the molten metal in the hot metal runner. An improved arrangement has now been devised.

According to a first aspect of the present invention, there is provided a method of introducing at least one additive into molten iron in a steelmaking process, in which the additive in particulate solid form is conveyed pneumatically to impinge upon the molten iron and mix therewith, the additive being pneumatically conveyed in a divergent stream from a pneumatic conveying outlet (or gun) spaced above a surface of molten iron present in a receptacle (such as a ladle), the conveying outlet being such that the pneumatically conveyed stream including the additive has a central axis which is either horizontal or at an acute angle to the horizontal.

It is preferred that the axis is adjustable from a first angle to a second angle inclined to the horizontal. Such an adjustable outlet enables the pneumatically conveyed stream to be accurately targeted to, for example, impinge upon a pouring stream or to substantially cover a surface of molten iron in a receptacle.

When the pneumatically conveyed stream is to substantially cover a surface of molten iron in a receptacle, the outlet is above, and preferably outwardly spaced from an outer edge of the receptacle. The term "iron" as used herein encompasses any predominantly ferrous metal or alloy (which may contain incidental ingredients or impurities) suitable for use in a steelmaking process. It specifically includes the material being poured from a converter vessel in the course of a steelmaking process.

The use of a pneumatically conveyed stream provides several benefits, including lower cost, and enhanced dispersal of the additive in the molten iron. In terms of cost, there is no requirement for a specially designed treatment station, because the relevant outlet nozzles ("guns") can be readily added to an existing plant structure, and an expensive and short-lived lance is not needed.

The central axis of the stream is one about which the stream diverges, to form a substantially divergent conical stream of pneumatically conveyed particulate additive, which impinges upon the molten iron in the form of projectiles.

The first angle may be substantially horizontal or at an acute angle to the horizontal; it should not be vertical.

It is particularly preferred in the method according to the invention that the pneumatic conveying outlet can be adjusted such that the angle of the axis of the stream can be optimised, depending on the application and the location of the surface of the molten iron.

When the pneumatically conveyed stream which includes the additive has a central axis which is substantially horizontal, the additive is preferably added to flowing molten iron during pouring of the latter (typically during pouring into a ladle or the like, the latter therefore including the surface of the molten iron referred to above). In this embodiment, the kinetic energy of the poured iron can assist in the dispersion of the additive directed thereto in a pneumatically conveyed stream. Such a method in which the additive is directed to molten iron being poured into a ladle or the like is described in more detail below.

When the central axis is at an acute angle to the horizontal, the additive may be added to the flowing molten iron during pouring, or (in a preferred embodiment of the invention) the additive may be directed towards the surface of molten iron in the receptacle.

When the stream including the additive is directed towards the surface of the molten iron in the receptacle, the additive is preferably conveyed to reach below the aforesaid surface, penetrating through slag or other surface covering thereon. It is particularly preferred in this embodiment of the invention that the stream is directed so as to substantially cover the entire surface of the molten iron in the receptacle, and impinge at least in part on sidewalls of the receptacle. This is contrary to the teachings of the abovementioned U.S. Pat. No. 4,601,749, where the added stream is directed vertically downwards to the surface of the molten iron with very little divergence of the stream.

According to the invention, however, the "footprint" of the conveyed additive preferably covers the entire surface of the molten iron in the receptacle. This can ensure, for example, that the total surface of molten iron in a ladle may be covered without the requirement to physically move either the conveying outlet or the conveyed stream so as to scan the entire molten iron surface. It is, however, possible to arrange for the stream to scan the surface, or to provide a plurality of such conveying outlets.

In further embodiments, different nozzles can be used for different applications, so that a widely divergent stream can be provided in some embodiments and a stream with little divergence can be formed in other circumstances.

In most applications of the present invention, it is preferred that the conveying gas will be air, although inert conveying gasses (such as nitrogen) may be preferred in some instances.

The additive may be in any suitable particulate form, such as tablets, pellets, briquettes or powder. The density and composition of such tablets, pellets, briquettes and the like may be tailored in order to penetrate to predetermined depths in the molten iron at a predetermined rate. This enables the additive to be tailored to perform specific reaction requirements at specific depths and times. For example, the specific density and composition of tablets introduced into molten iron may be selected to break down quickly when in the presence of hot slag, but to react with the specific chemical components in the molten iron which are targeted for neutralisation or alteration.

The predetermined specific density of the particulate additive can ensure that the particles penetrate into, and remain in, the slag (rather than descending into the liquid iron below) but resist flaring off on the surface.

Significant upward thermal currents exist above the surface of molten iron, which would hinder the deployment of additive by gravity feed. The use of the conveying gas delivery arrangement in the method according to the invention can ensure that the effect of the upward thermal air currents above the molten iron can be compensated for.

The delivery pressure and velocity of the conveying gas can therefore be tailored, depending upon the 'sinkage' requirements of the additive being delivered and the upward thermal currents encountered above the molten iron in the relevant process stage. Typically, the dispensing pressure of the conveying gas will preferably be substantially in the range of 7 bars plus or minus 20%. The discharge rate of dispensed material is preferably substantially in the range 0.5 to 15 $m^3$ per hour.

Preferably, the conveying outlet comprises a nozzle, preferably a diverging nozzle arranged to induce a diverging outlet stream which fans or diverges outwardly in a direction away from the nozzle.

In some embodiments, the molten iron is preferably contained in a substantially molten state in a receptacle, such as a ladle, flowpath channel, duct or the like. It is preferred that the receptacle is in the form of a ladle, and that (in this embodiment) the conveyed stream is arranged to impinge walls of the ladle substantially surrounding the surface of the molten iron therein.

In other embodiments, it is preferred that the surface of the molten iron should be below a flow of metal being poured thereinto; in this embodiment, it is preferred that the additive is pneumatically conveyed according to the invention into the pouring stream of metal. This enables the available kinetic energy of the flowing stream of metal to be efficiently utilised to aid dispersion of the Additive, without the need to use expensive gases for stirring. Furthermore, as the addition in this embodiment takes place during an existing process (that is, the usual pouring from one ladle to another), no additional process step or time is needed. The additive can in addition be dispersed intimately throughout the molten iron so that the additive is able to react in a manner of optimum efficiency.

In some embodiments of the invention, it is preferred that the additive comprises a multiplicity of shaped elements (such as tablets, briquettes or the like), which preferably include aluminium when the additive is to be used for reheating steel during secondary steel making, or for "killing" slag on the surface of a steel ladle. Such shaped elements preferably comprise compressed divided material, which form individual self-supporting elements.

Especially when such elements are used for killing slags, it may be beneficial to include calcium carbonate, such that when reaction takes place with the slag, carbon dioxide will be released, which will then gently bubble and effectively stir in the aluminium.

It is sometimes preferred that shaped elements such as those described above should include swarf, chippings, grindings or other divided aluminium, compressed to form self-supporting shaped elements; they may optionally contain iron (typically in form of an oxide, which is especially preferred to be in the form of millscale, because the latter closely mirrors the specifications generally required by a steel manufacturer).

The shaped elements may additionally or alternatively include one or more non-aluminium materials, preferably arranged to have a conditioning influence upon molten iron or slag. For example, the shaped elements may include slag conditioning additives and/or ladle insulating powders.

One or more of the following materials may be included in the additive used according to the invention, depending upon user requirements: lime, magnesia, alumina, fluorspar, silicon or the like. Each of these materials is commonly used in steelmaking processes, generally in order to aid process control.

Such additives may be bound in the shaped elements as divided material (fine or coarse); in certain embodiments they may be distributed throughout a shaped body predominantly of aluminium.

In one embodiment of the invention, the additive may include or consist essentially of lime, which may be in the form of relatively small briquettes. In this embodiment, the lime is typically pneumatically conveyed or gunned into a tapping stream or the like in which the iron is tapped from a converter vessel and the lime is added or gunned into the stream in a tight cone. This can reduce dust in adding the lime and can avoid large amounts of the lime remaining unreactive on the surface of a ladle or the like.

In a further embodiment of the invention, the additive may be in the form of small briquettes containing lime, aluminium and soda ash, which can thereby be used as a desulphurising medium for molten iron. In this embodiment, the additive can be fired into a poured stream of the metal (for example when the latter is being poured from a blast furnace torpedo car into a BOS plant transfer ladle. The pouring action releases large amounts of kinetic energy and additive material can be drawn and stirred into the molten iron without the costs and delays associated with conventional systems.

According to a second aspect, the invention provides steelmaking apparatus comprising:

i) a receptacle, channel or flowpath containing molten iron;

ii) a pneumatic conveying outlet spaced above the surface of the molten iron, the conveying outlet being arranged to deliver additive in a pneumatically conveyed divergent stream to penetrate into the molten iron,the conveying outlet being adjustable so that the pneumatically conveyed stream can have either a central axis which is substantially horizontal, or a central axis which is at an acute angle to the horizontal.

The invention will now be further described in specific embodiments, by way of example only, with reference to the accompanying drawings, in which.

Figure 1:
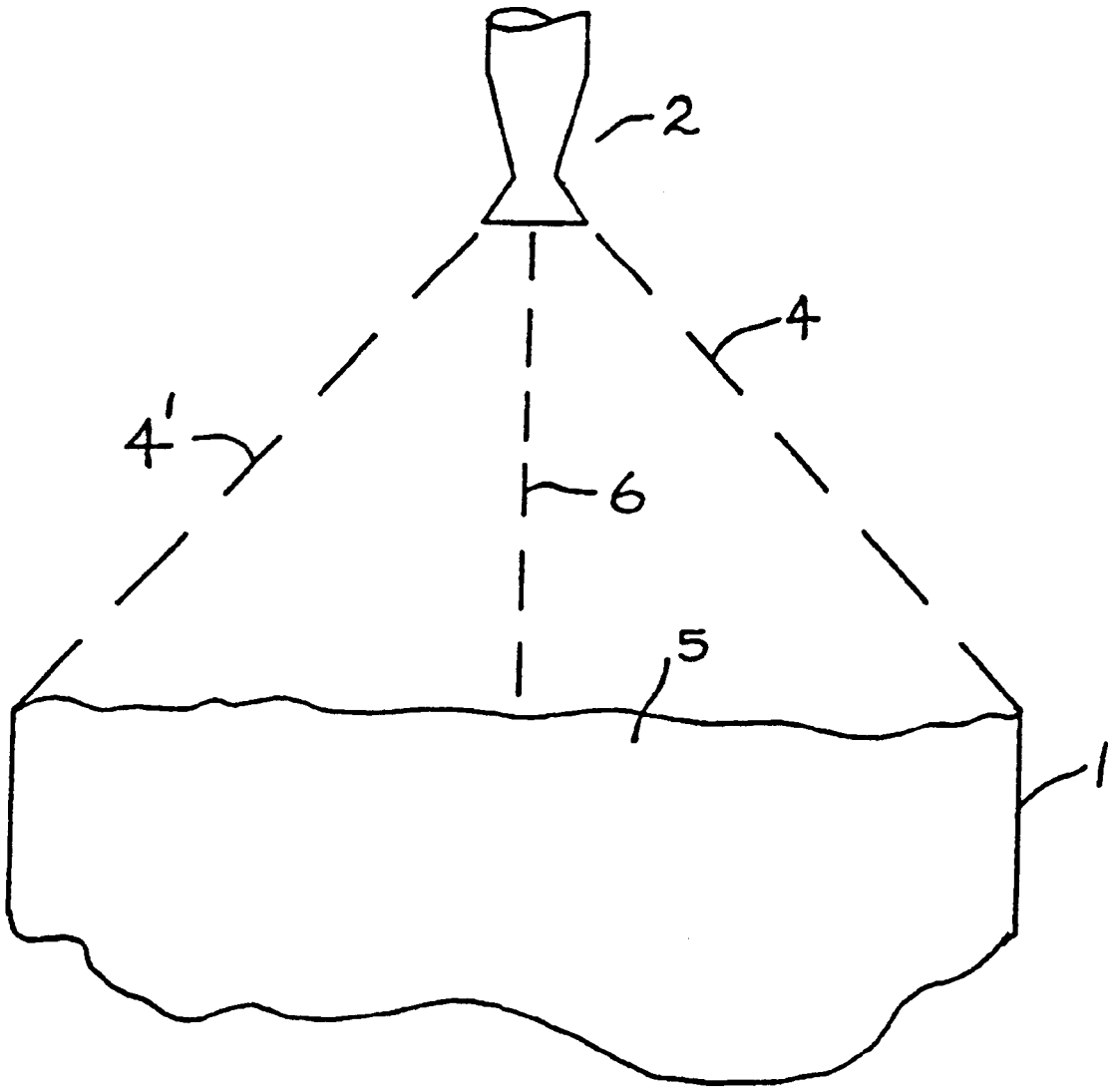
FIG. 1 is a schematic end view showing certain features of an exemplary embodiment of a method according to the invention.
Figure 2:
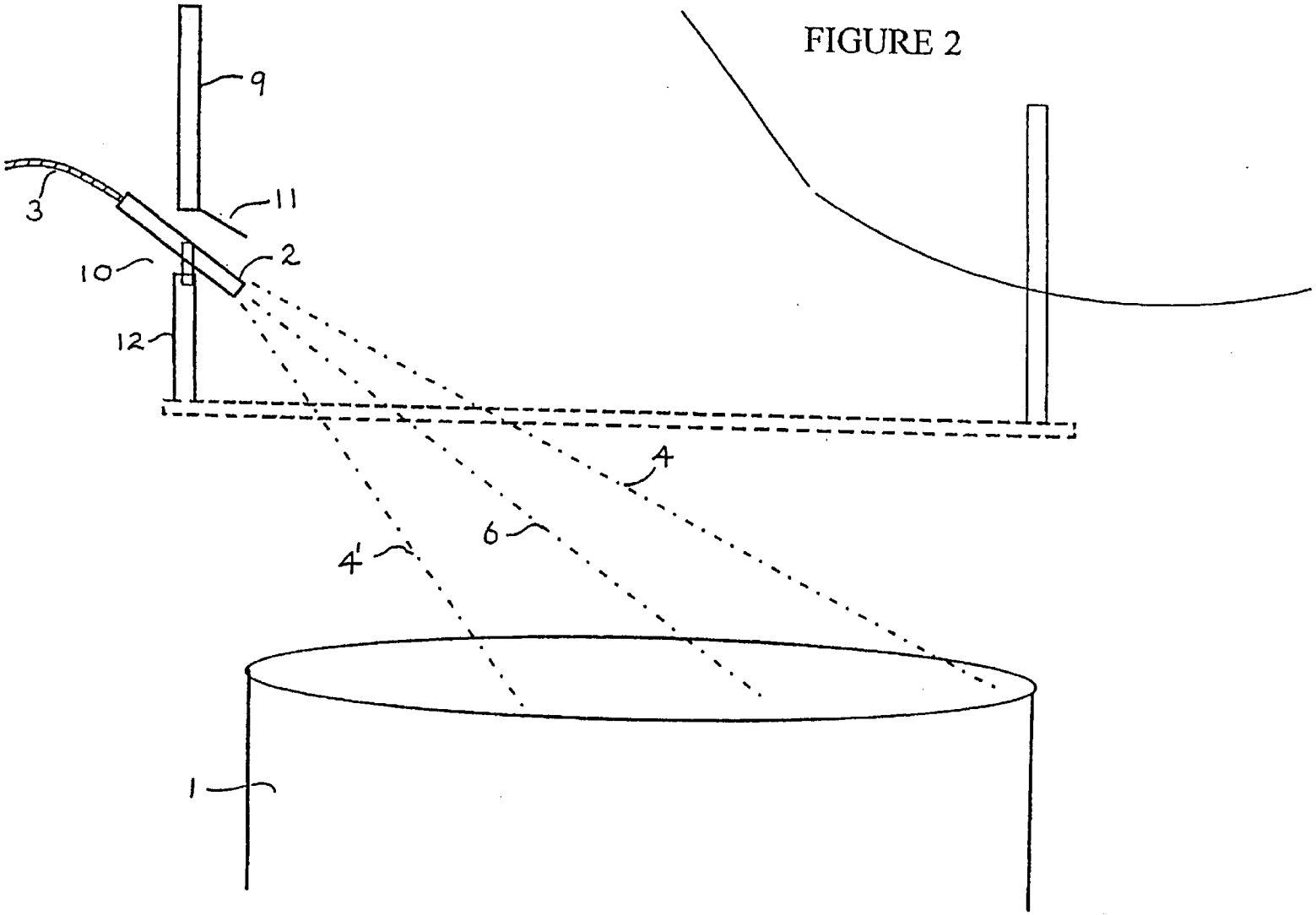
FIG. 2 is a schematic side view showing in more detail features of the method illustrated in FIG. 1.
Figure 2A:
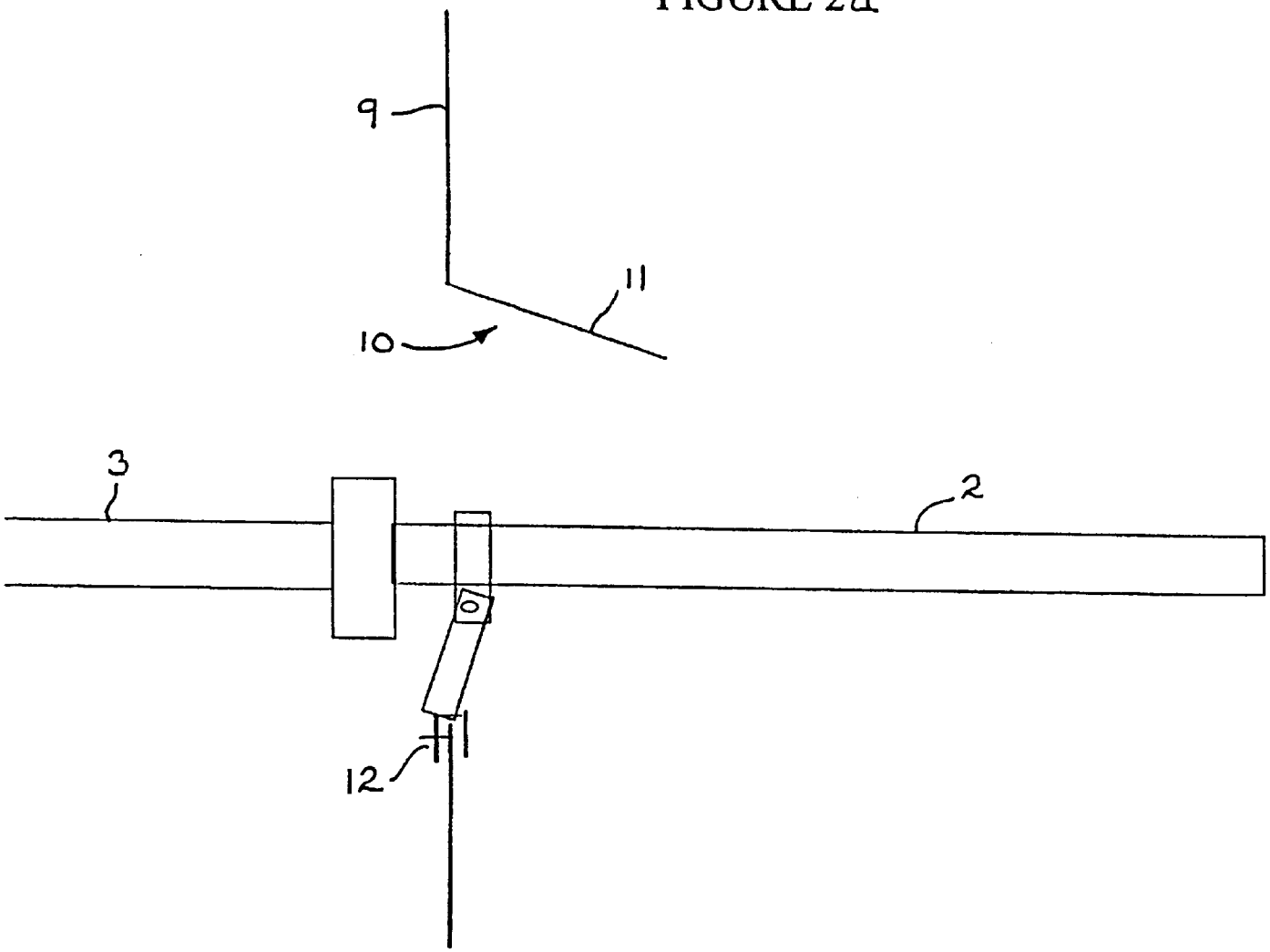
Figure 3:
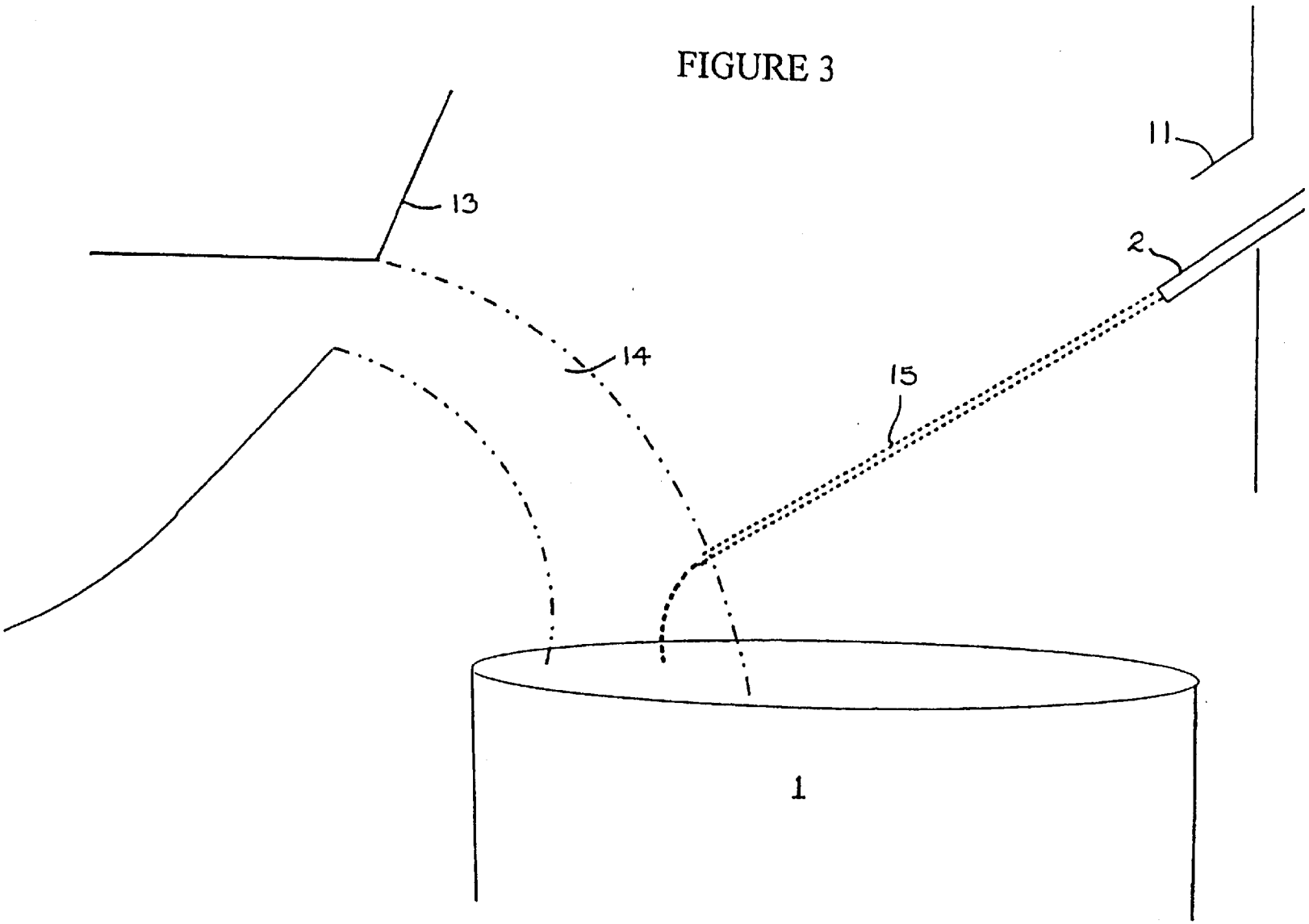
Figure 4:
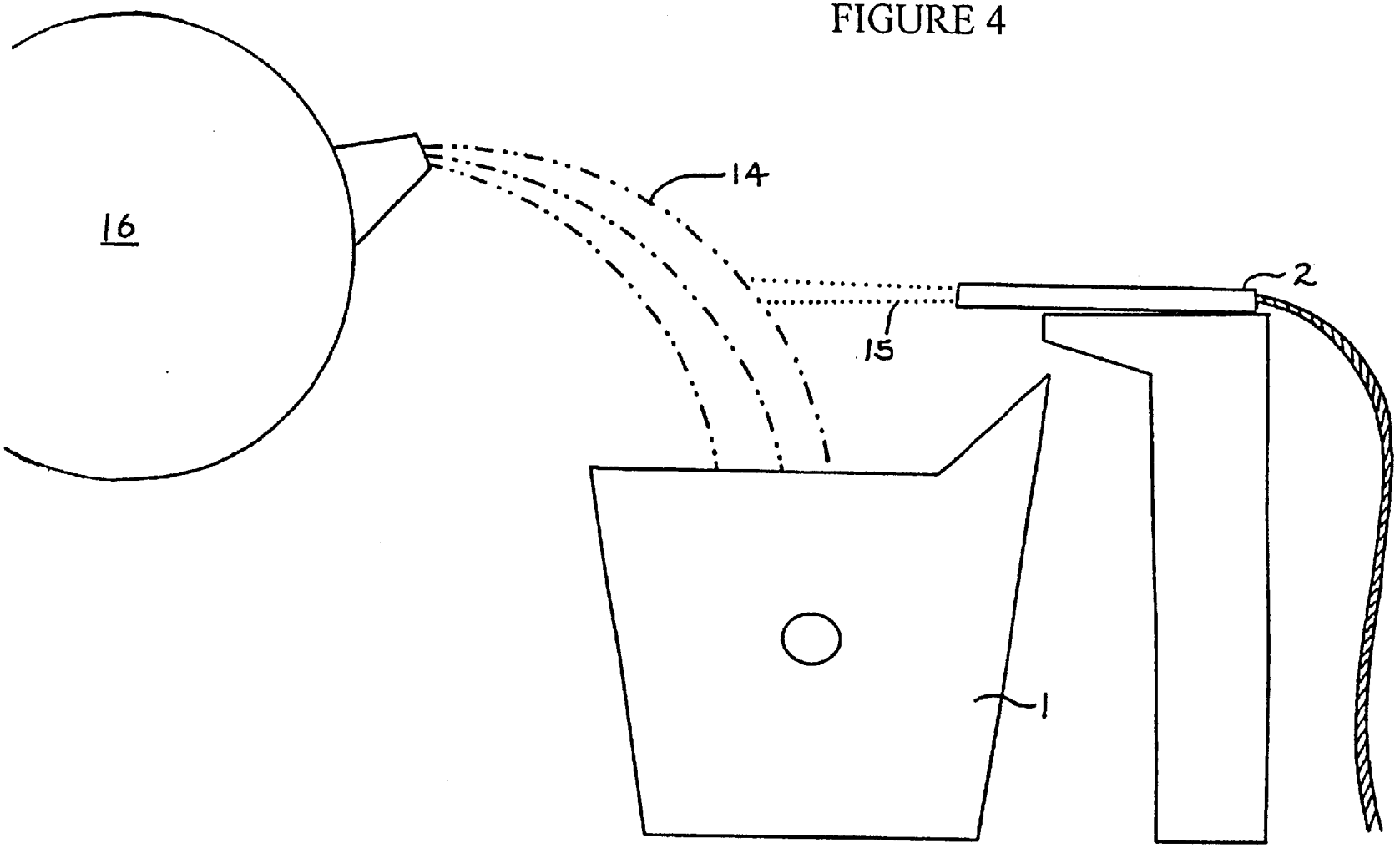

FIG. 2*a* shows in more detail the connection of the gun shown in FIGS. 1 and 2 to the wall of a converter housing;

FIG. 3 is a schematic view of an alternative embodiment in which lime is gunned into a pouring stream; and FIG. 4 is a schematic view of an embodiment similar to FIG. 3, for the purpose of desulphurising of molten iron being transferred to a ladle.

Referring to FIGS. 1 and 2, a ladle 1 containing molten iron and slag is positioned below a nozzle outlet of a gun 2. Gun 2 is connected via a pneumatic line 3 (not shown in FIG. 1) for distributing additive supplied from a hopper (not shown) to the surface 5 (see FIG. 1) of metal in the ladle 1. The metal stream from outlet 2 has diverging edges 4,4' and a central axis 6 which is inclined to the horizontal (as seen more clearly in FIG. 2).

The gun 2 is pivotally mounted at 7 to the wall 8 of a converter housing 9; the pivotal mounting is such that the gun can pivot about two axes to permit spraying accuracy. More details of the pivotal mounting are shown in FIG. 2*a*; it can be seen that the pivotal mounting for the gun 2 is clamped to the lower edge of an access hatch 10 cut into converter housing 9, the hatch having a deflection hood 11.

The mounting allows the nozzle outlet of the gun to move both up and down, and left and right. A clamp 12 secures the nozzle outlet of gun 2 to the pivotal mounting 13 and can be slackened and the gun withdrawn for quick changeover.

A hopper store (not shown) delivers particulate additive material in tablet/pellet form (or the like) to line 3 and then to gun 4 to be distributed over the surface 5 of the molten metal (and slag) in ladle 1.

The pneumatic conveying system typically has a range of output discharge rates, typically in the range 0.75 to 10 $m^3$ per hour, the desired output being tailored to the process condition required for a particular application and the volume and density of the additive material being conveyed.

The process parameters to which the output needs to be tailored are:

i) tablet/pellet size and/or density for the additive;

ii) thermal updraft from the molten iron in the ladle 1; and/or iii) desired penetration depth (and/or rate of penetration) into the molten iron in ladle 1.

The pneumatic gun 2 is tailored such that the height of its nozzle above the ladle 1 can ensure that the divergent edges 4,4' of the spray of the conveying gas and additive are dimensioned to substantially cover the width dimension (or span) of the surface 5 across ladle l, as shown in FIGS. 1 and 2. This ensures that there is no need for scanning of the output spray.

Utilising the pneumatically conveyed additive ensures rapid uniform coverage of the relevant additive over the surface 5 of the molten iron in the ladle 1. Additionally, the pressure of the conveying gas may be tailored to ensure that thermal updraft from the molten iron is compensated for, permitting additive to be introduced to penetrate to required depths within the molten iron at specific rates to perform a specific chemical interaction within the molten iron. The additive may be aluminium, aluminium based or other material such as (non-exhaustively) lime, magnesia, alumina, fluorspar, millscale, steel turnings or the like. Each of these materials is commonly used in steelmaking processes in order to aid process control and steel conditioning.

Typically, the additive is compressed (or otherwise bonded) from non self-supporting agglomerations of relevant material into the form of pellets, tablets, briquettes or the like. Such briquettes may include one or more combinations of the additive in varying proportions depending on application requirements.

The density of the relevant tablets, pellets, briquettes or the like is pre-selected to meet the required performance characteristics. For example, shaped bodies formed by briquetting for use according to the invention may have a density in the range 2.2 to 2.8 $Kgm^{-3}$; whereas shaped bodies formed by tableting or pelletizing may have a density in the range 1.4 to 4 $Kgm^{-3}$.

Referring now to FIG. 3 (in which like parts are denoted by like reference numerals), there is shown a schematic view of an alternative embodiment, in which a converter vessel 13 is arranged to pour molten iron in the form of a stream 14. While in flight, the molten iron is impinged by a further stream 15 of lime, directed from pneumatic gun 2.

The small lime briquettes are fired into the poured stream of molten iron during tapping. The briquettes are dragged down into the ladle and mix with the molten metal where the lime can mix efficiently.

Referring now to FIG. 4 (in which again like parts are denoted by like reference numerals), the iron is being poured from a mixer 20 to a ladle 1; while in flight, the molten iron stream 14 is impinged by a a substantially horizontal diverging stream 15 of desulphurising pellets from gun 2.

What is claimed is:

1. A method for killing slag on the surface of molten steel present in a receptacle, in which additive material including aluminum material in particulate or divided solid form is gas conveyed to the slag in a conveying gas in a divergent stream from conveying apparatus spaced above the slag surface, the conveying gas pressure being tailored with respect to the conveyed additive material to cause the conveyed additive material to penetrate into and substantially remain in the slag.

2. A method according to claim 1, wherein gas conveyed additive is directed to impinge with slag extending over the majority of the surface area of the molten steel in receptacle.

3. A method according to claim 1, wherein the additive material is bound into a multiplicity of shaped elements.

4. A method according to claim 3, wherein the shaped elements comprise compressed divided material forming individual self-supporting elements.

5. A method according to claim 4, wherein the shaped elements are selected from the group consisting of swarf, chippings, and grindings.

6. A method according to claim 1, wherein the outlet of the conveying apparatus is above and outwardly spaced from an outer edge of the receptacle.

7. A method according to claim 1, wherein the density and/or composition of the additive material is/are tailored with respect to parameters of the conveying gas so as to provide that the additive material penetrates into the slag to a predetermined extent.

8. A method according to claim 1, wherein the gas conveyed stream is configured to ensure that at least the majority of the surface of the slag in the vessel is covered by the gas conveyed additive.

9. A method according to claim 1 wherein the additive is gas conveyed at a dispensing pressure of conveying gas substantially in the range 7 bars plus or minus 20%.

10. A method according to claim 1, wherein the additive is conveyed at a rate substantially in the range 0.5 to 15 $m^3$ per hour.

11. A method for killing slag on the surface of molten steel present in a receptacle, in which additive material including aluminium material in particulate or divided solid form is gas conveyed to the slag in a conveying gas in an inclined divergent stream from an inclined conveying apparatus spaced above the slag surface, the conveying gas surface being tailored with respect to the conveyed additive material to cause the conveyed additive material to penetrate into and substantially remain in the slag.

* * * * *